United States Patent [19]

Walker

[11] 4,359,060

[45] Nov. 16, 1982

[54] NAIL POLISH DISPENSING APPARATUS

[76] Inventor: Edith Walker, 664 E. 31 St., Brooklyn, N.Y. 11210

[21] Appl. No.: 125,329

[22] Filed: Feb. 28, 1980

Related U.S. Application Data

[63] Continuation-in-part of Ser. No. 882,168, Dec. 7, 1978, abandoned.

[51] Int. Cl.[3] ..... A45D 29/20

[52] U.S. Cl. ..... 132/75

[58] Field of Search ..... 132/75, 79

[56] References Cited

U.S. PATENT DOCUMENTS

| | | | |
|---|---|---|---|
| 1,009,047 | 11/1911 | Capitain | 132/79 R |
| 2,145,462 | 1/1939 | Speck | 132/79 G |
| 2,382,061 | 8/1945 | Janchick | 132/79 G |
| 2,553,348 | 5/1951 | Zurndorfer | 132/79 G |
| 3,478,763 | 11/1969 | Weinstein | 132/75 |

*Primary Examiner*—G. E. McNeill

*Attorney, Agent, or Firm*—Robert L. Slater, Jr.

[57] ABSTRACT

An apparatus for dispensing nail polish and remover from the bottles of same without spilling the contents over rugs, clothes or furniture. The apparatus is comprised of a housing residing atop a base, the housing having two opposed side walls. The remaining sides are open to allow access to the bottles which are held within pivotably mounted receptacles on the interior of the side walls. Side compartments are provided for temporary storage of the nail cleaning and polishing implements, while a permanent storage drawer may be provided in the base of the device. In addition, the bottles may be stored on the floor of the housing while not in use by means of spring clips located in the floor.

6 Claims, 4 Drawing Figures

NAIL POLISH DISPENSING APPARATUS

CROSS REFERENCE TO PRIOR APPLICATION

This application is a continuation-in-part in copending U.S. Application Ser. No. 882,168 filed Dec. 7, 1978, now abandoned.

FIELD OF INVENTION

The present invention relates to a nail polish dispensing apparatus which houses the bottles of nail polish and polish remover during use thereby avoiding spillage of the contents. The apparatus has side compartments for files, clippers, emery boards, cotton and other instruments used in the nail polishing procedure. Optionally, in the preferred embodiment a drawer is provided in the base of the apparatus for storage of the manicure implements.

BACKGROUND OF INVENTION

Long, polished nails are well established prerequisites of fine grooming. Many hours are spent in the preparation of a woman's nails. The old polish is removed, cuticles trimmed or removed, the nails clipped and filed. New polish is then applied, and upon drying, a hardening lacquer may also be applied.

Long nails, however, are cumbersome, and pose an inherent problem during the application of polish. In reaching for the bottle of polish, even the most careful woman has, on occasion, caught the tip of a nail on the edge of the bottle thereby spilling its contents over rugs, clothes and furniture.

The prior art illustrates how to store the clippers, bottles, files and the like, but has not addressed the problem of providing a safe repository for the polish and remover during use.

SUMMARY OF INVENTION

It is a primary object of the present invention to provide an apparatus for dispensing nail polish.

It is a further object of the apparatus to provide a means by which nail polish and nail polish remover may be dispensed without spilling the contents of the bottle.

It is also an object to organize the utensils and instruments used during the nail polishing operation.

Another object of the invention is to provide a container for the clippers, emery boards, nail files and other instruments while the nails are being manicured and polished.

An associated object of the invention is to provide a storage compartment for the instruments unitary with the dispensing apparatus, and storage means for the nail polish and remover when not in use.

These and other objects of the apparatus will be apparent from an inspection of the specification, drawings and claims.

In summary the apparatus comprises a housing, two opposed sides of which are open. The housing resides atop a base which has trays or compartments preferably located adjacent to each open side. These trays are used for storing the emery boards, clippers, files, cotton and the like in use during the nail polishing procedure. In the preferred embodiment a drawer is provided in the base of the apparatus in which a manicure set may be stored. Means may also be provided for storing bottles of nail polish and remover when such are not in use.

A receptacle is mounted pivotably on the interior surface of each side wall of the housing, said receptacles being of such size and shape to receive respectively a bottle of nail polish and a bottle of nail polish remover. Pivot pins extending through the walls and attached to knobs located on the outside surface of the housing provide means for rotating the receptacles. When bottles are placed in the receptacles, the contents can be accessed through the open side walls by rotation of the receptacle using the knobs cooperating therewith.

DETAILED DESCRIPTION OF THE PREFERRED EMBODIMENT

Figure 1:
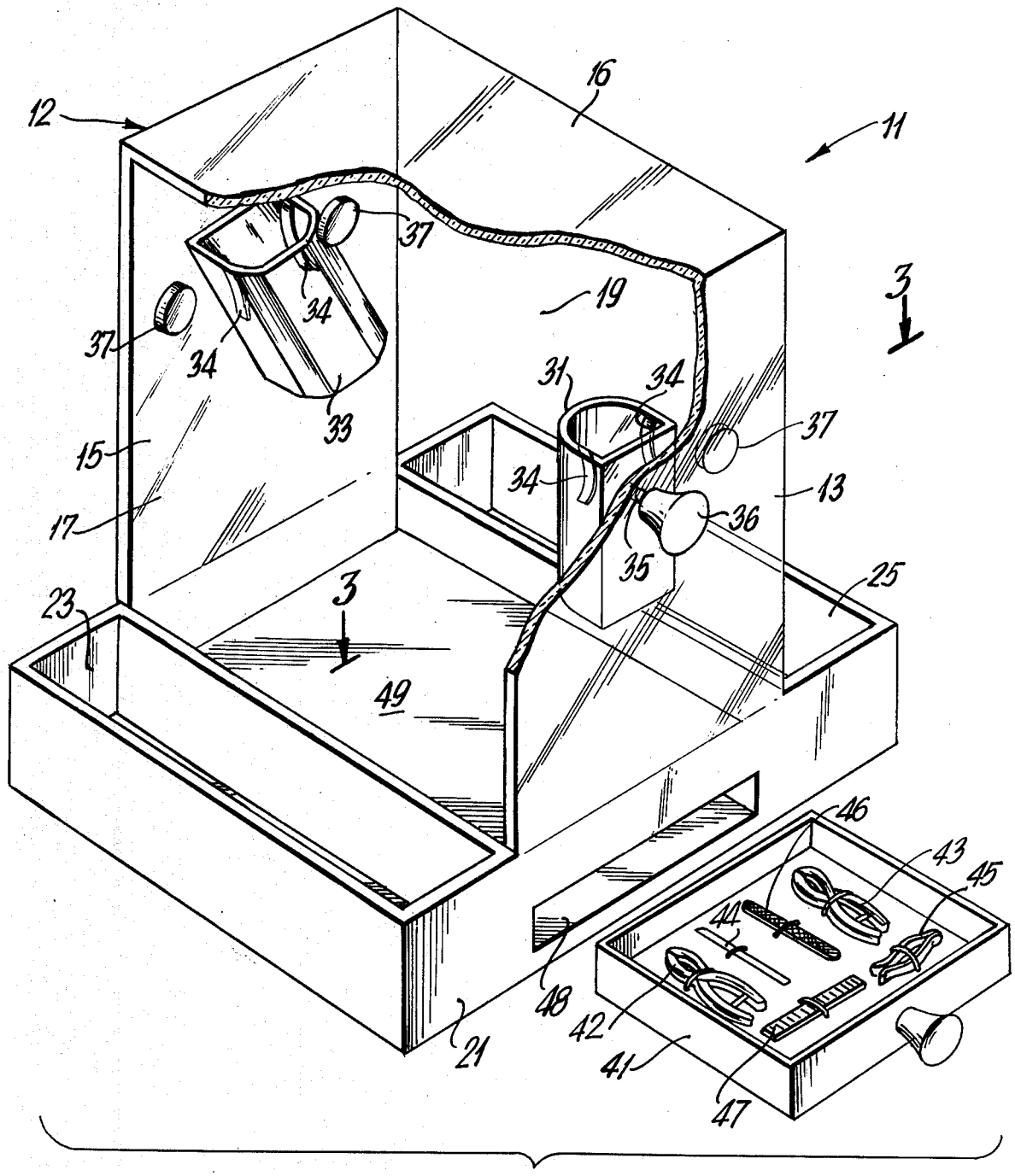
FIG. 1 is a perspective drawing in partial section of the preferred embodiment.

Referring to FIG. 1 the nail polish dispensing device 11 is shown in a partial cross sectional perspective view. The device comprises a housing 12 having two opposed side walls 13 and 15 and a top 16. The remaining opposed sides of the housing 17 and 19 are open so that the interior of the housing may be easily accessed.

Figure 2:
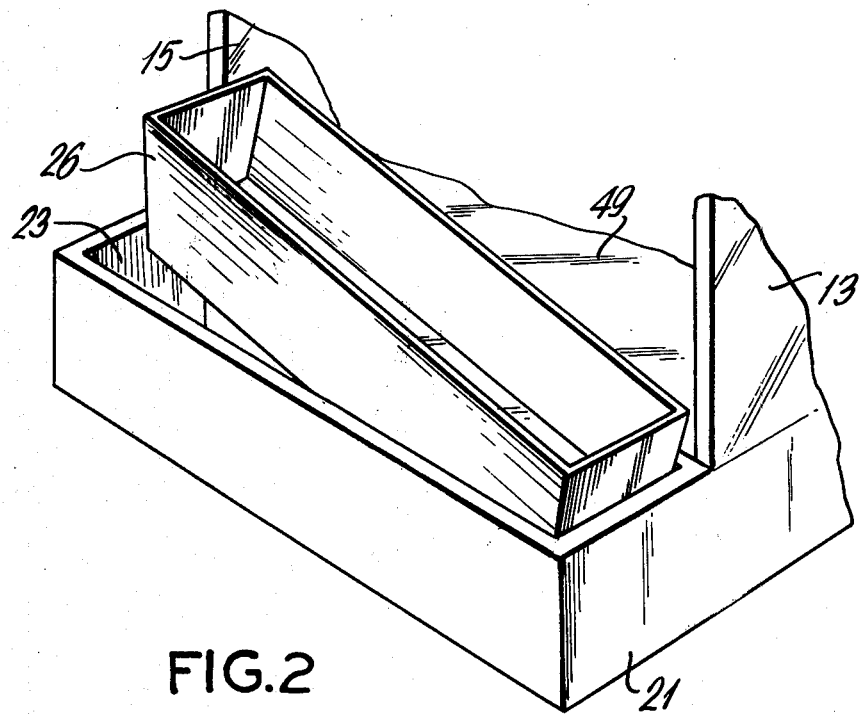
FIG. 2 is a partial view of the compartment within the invention of FIG. 1 showing the use of the plastic inserts.

The housing 12 resides atop a base portion 21 of the device 11 which is somewhat longer than the width of the housing in the preferred embodiment. Adjacent to the sides 17 and 19 and integral to the base 21 are open side compartments 23 and 25. The compartments 23 and 25 are provided for use during the nail polishing procedure as a container for the nail trimming, filing and polishing instruments. In the preferred embodiment the compartments 23 and 25 each have a plastic insert 26 which conforms to the shape of the compartment. These are illustrated in FIG. 2 and are provided for easy cleaning of the compartment after use.

Referring again to FIG. 1, receptacles 31 and 33 are provided on the interior side walls 13 and 15 respectively of the housing 12. Generally, the shape of the receptacles can be considered hemicylindrical, the flat portion thereof resting flush against the respective side wall. Although bottles of nail polish come in different geometries, depending on manufacturer, size and shape are more or less standardized within the industry. Thus, the configuration of one receptacle, e.g., 31, is adapted preferably to receive the irregular shapes of the nail polish bottles. Hence, one size receptacle 31 may be provided for use with most if not all such bottles. It is intended that receptacle 31 be such that any bottle of nail polish will fit loosely therein, but with as little "play" as possible. Using the same reasoning, the receptacle 33 has a shape that will allow nail polish remover bottles to fit loosely therein, but again have little play. Of course, a receptacle is not the only means for securing the bottles to the intereior side walls of the housing. For example, spring clips (not shown) may be used in lieu of said receptacles. However, the receptacles 31 and 33 are preferred because they enclose the bottles in a contained volume. The bottles cannot slip or slide from the receptacles. In addition, the receptacles can be used with a myriad of irregularly shaped bottles.

In the preferred embodiment of the invention, the inside of the receptacles are provided with spring clips 34 thereby minimizing what little variance exists in bottle size between the various manufactures. When the bottle of polish or remover is inserted into its respective container 31 or 33, the clips are compressed against the interior of the container, thereby providing a snug fit for the bottle.

Figure 3:
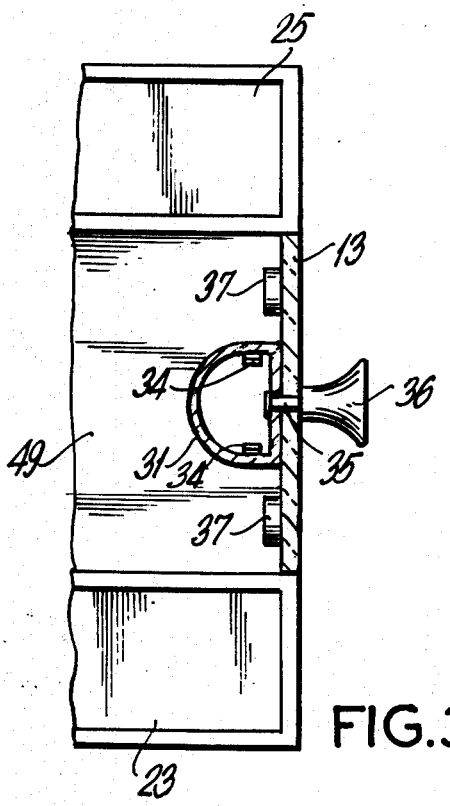
FIG. 3 is a view of the preferred embodiment of FIG. 1 along section 3—3.

As most conveniently visualized by reference to FIG. 1, a cross sectional view along section 3—3 of FIG. 3, the receptacles 31 and 33 are attached to the interior of the side walls by pivot pins 35 which extend through the side walls to knobs 36. By rotating the knobs 36, the bottles can be accessed through open sides 17 and 19. The knobs should extend significantly away from the walls 13 and 15, and should preferably by hyperbolically shaped as shown in FIG. 3, the part of the knob in contact with the wall being the smallest diameter. Thus, when rotating the bottle, the polisher's nail will not come into direct contact with the housing or knob. Preferably, the knobs are placed so that the pivot pins pass through the receptacles above the center of gravity thereof. Thus, a bottle always returns to the vertical position when a knob is released. To prevent the bottles from being completely rotated, stops 37 are placed on either side of the receptacles.

To use, the bottle is inserted in the proper receptacle, said receptacle then be rotated by turning the knob, whereby the contents of the bottle flow towards the lips thereof, and are conveniently reached with a conventional applicator generally supplied with the bottle.

The housing may be fabricated from any material, e.g., wood, metal, plastic. However, the side walls 13 and 15 and the top 16 are most preferably constructed from a transparent plastic material so that the polisher can see the interior of the device. The base 21 can be of any suitable material such as wood, metal or plastic. However, counterweights (not shown) are preferably provided in the base to increase the stability of the device.

During the nail polishing procedure it is desirable that the implements being used be within easy reach. For this reason the compartments 23 and 25 are provided. Hence, files, clippers, cuticle remover, emery board, cotton and the like can be placed there for ready access.

Figure 4:
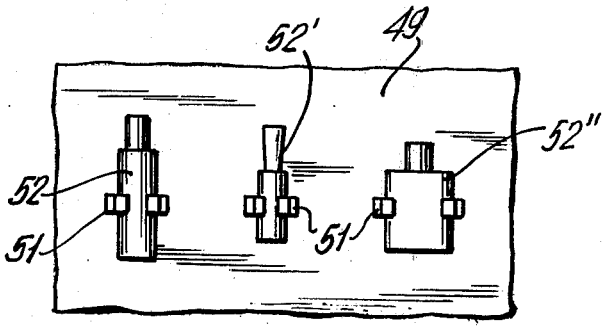
FIG. 4 is a fragmentary view of the floor of the apparatus in FIG. 1 illustrating the storage of nail polish and nail polish remover bottles when such are not in use.

In the embodiment illustrated in FIG. 1, optional drawer 41 is provided to permanently store the above mentioned implements when the device is not in use. Thus, clippers 42, 43, cuticle remover 44, tweezers 45, emery board 46, and file 47 can be stored. Drawer 41 is slidable within recess 48 located in the base 21 of the device 11. The drawer is preferably lined with felt, leather, vinyl plastic, and the like, while the base is preferably felt lined to prevent scratching of furniture. In the embodiment containing drawer 41 a floor 49 is placed within the housing to completely enclose the drawer. As shown in FIG. 4 floor 49 may also be provided with a plurality of mounting means 51 for storing horizontally one or more bottles 52, 52' and 52'' and the like, said mounting means 51 being sized so that variously sized bottles may be stored therein.

It is understood that various departures may be made from the preferred embodiments of the invention without deviating from the main theme of the invention as set forth in the claims which follow.

I claim:

1. A device for dispensing nail polish and nail polish remover from their bottles without spillage, the device comprising:

(a) a rectangular housing having two opposing side walls, the remaining side thereof being opened to provide access to the interior of said housing, (b) a base supporting said housing, (c) a plurality of recepticles each recepticle being adapted to receive a bottle, the recepticles being pivotably mounted on the side walls, one side of each recepticle being flush with its respective side wall, (d) a plurality of knobs for rotating said receptacles positioned on the exterior of the side walls and attached to the receptacles by pivot pins, said knobs being located above the center of gravity of said receptacles, (e) not more than two compartments within the base supporting said housing, the compartments having an open top and being juxtaposed adjacent to the open sides of the housing, and (f) not more than two plastic inserts within the compartments adjacent to the base, said inserts being removable for cleaning ease.

2. The device of claim 1 wherein the receptacles have one or more spring clips located therein to securely clasp the bottles within the receptacle.

3. The device of claim 2 further comprising stop means located on the interior side walls and adjacent the receptacles so that complete rotation of the receptacles is prevented.

4. The device of claim 3 further comprising a slidable permanent storage drawer for manicure implements, said tray being located in the base of the device.

5. The device of claim 4 further comprising a plurality of spring clips for securing horizontally bottles of nail polish and remover, said spring clips being in the floor of the housing whereby the bottles may be stored while not in use.

6. The device of claim 5 wherein the housing is preferably fabricated from a transparent plastic material and further comprising a felt padding in the base, said base being counterweighted for stability.

* * * * *